US006997856B1

(12) United States Patent
Krull

(10) Patent No.: US 6,997,856 B1
(45) Date of Patent: Feb. 14, 2006

(54) ADJUSTABLE WEIGHT EXERCISE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 0 days.

(21) Appl. No.: 10/445,115

(22) Filed: May 23, 2003

Related U.S. Application Data

(60) Provisional application No. 60/383,544, filed on May 23, 2002.

(51) Int. Cl.
*A63B 21/078* (2006.01)

(52) U.S. Cl. ..... 482/104; 482/106; 482/107; 482/108

(58) Field of Classification Search ..... 482/104–109, 482/148
See application file for complete search history.

(56) References Cited

U.S. PATENT DOCUMENTS 145,145 A * 12/1873 Baggs ..... 119/69.5
4,107,830 A * 8/1978 Thomson ..... 29/110.5
4,826,159 A * 5/1989 Hersey ..... 272/146
5,643,182 A * 7/1997 Engel ..... 601/119
6,017,297 A * 1/2000 Collins ..... 482/146
6,059,700 A * 5/2000 Ellenburg ..... 482/107
6,228,003 B1 * 5/2001 Hald et al. ..... 482/107
6,261,022 B1 * 7/2001 Dalebout et al. ..... 482/107
6,500,101 B1 * 12/2002 Chen ..... 482/107
6,656,093 B2 * 12/2003 Chen ..... 482/108
2004/0005968 A1 * 1/2004 Crawford et al. ..... 482/106

* cited by examiner

*Primary Examiner*—Gregory L. Huson
*Assistant Examiner*—L. Amerson

(57) ABSTRACT

An exercise dumbbell includes a handle assembly and weight plates maintained in spaced relationship relative thereto. At each end of the dumbbell, a weight selector is maneuverable into and out of engagement with desired weight plates to secure same relative to the handle assembly. The weight selector includes both a first selector rod segment that is configured to selectively engage at least a first one of the weight plates, and a second selector rod segment that is configured to selectively engage at least a second, discrete one of the weight plates.

25 Claims, 6 Drawing Sheets

Fig. 3
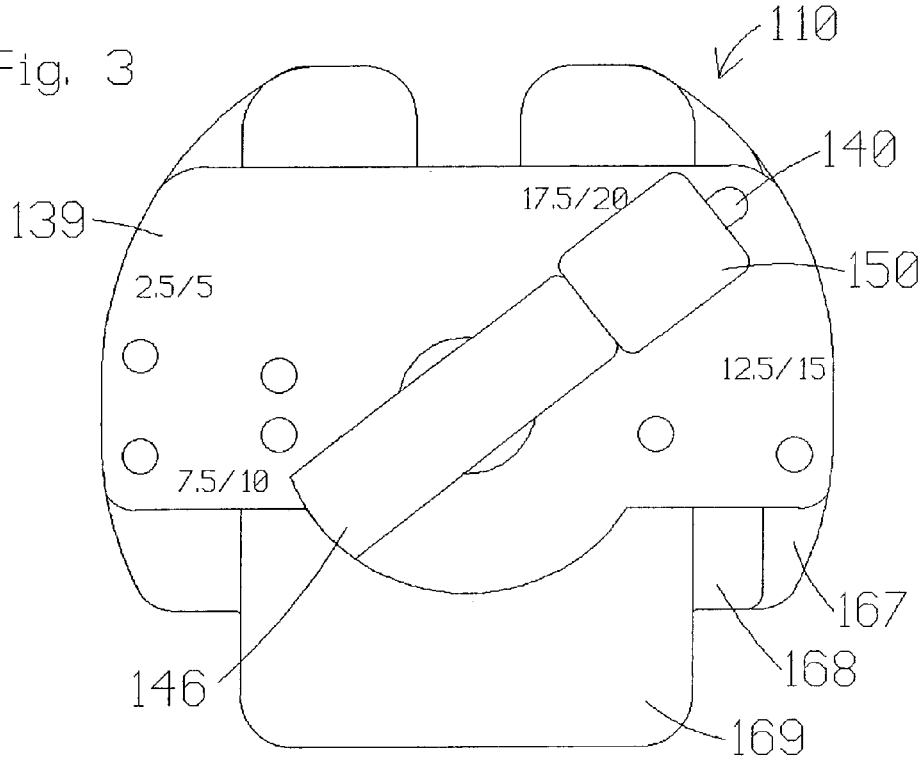
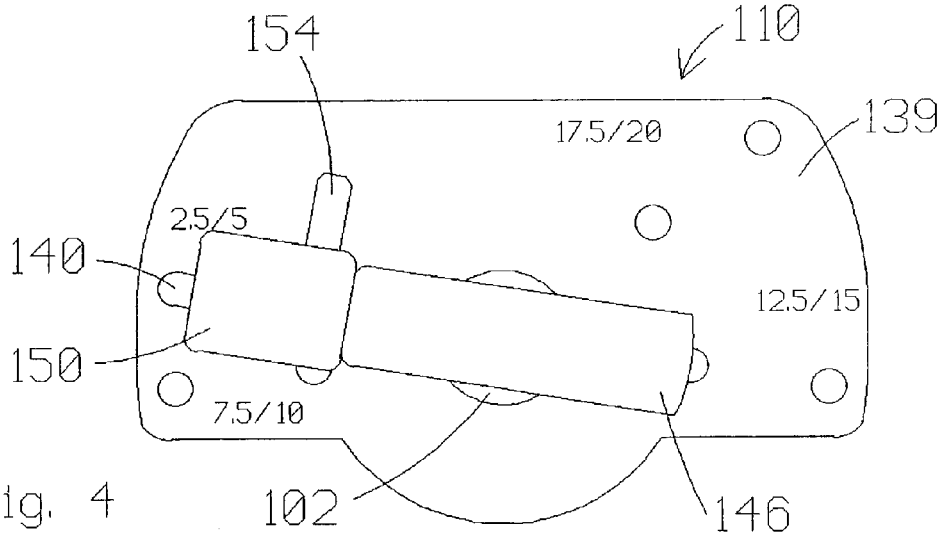
Fig. 4

Fig. 9
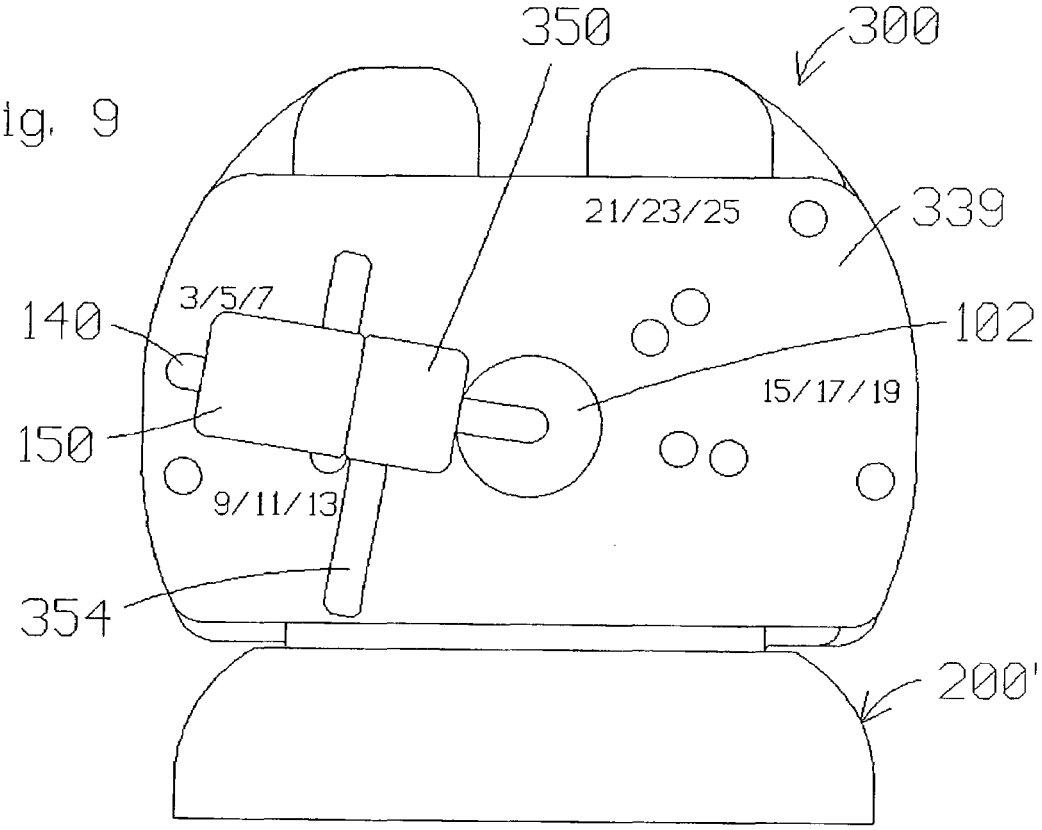
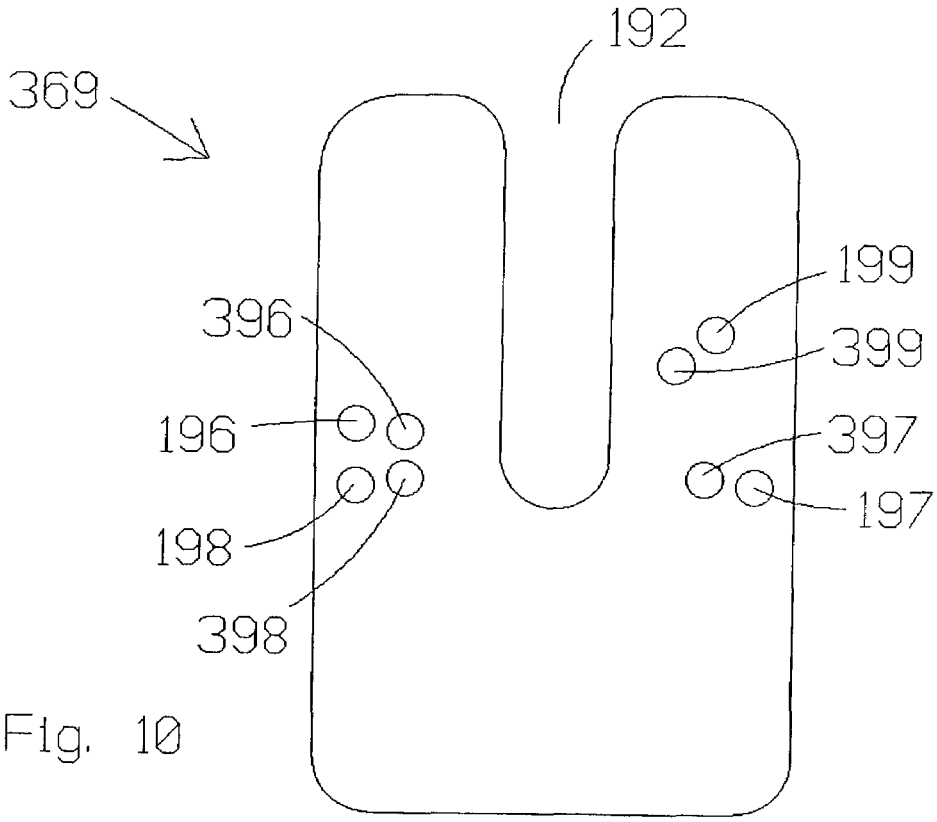
Fig. 10

ADJUSTABLE WEIGHT EXERCISE METHODS AND APPARATUS

CROSS-REFERENCE TO RELATED APPLICATION

Disclosed herein is subject matter that is entitled to the filing date of U.S. Provisional Application No. 60/383,544, filed on May 23, 2002.

FIELD OF THE INVENTION

The present invention relates to exercise equipment and more particularly, to methods and apparatus for adjusting weight resistance to exercise.

BACKGROUND OF THE INVENTION

Past efforts have led to various inventions directed toward adjustable weight exercise devices. Some examples of such efforts in the field of free weights are disclosed in U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley, III et al.; U.S. Pat. No. 5,839,997 to Roth et al.; U.S. Pat. No. 6,099,442 to Krull; U.S. Pat. No. 6,033,350 to Krull; and U.S. Pat. No. 6,322,481 to Krull. Despite these advances and others in the field of weight lifting equipment, room for continued improvement remains.

SUMMARY OF THE INVENTION

The present invention provides methods and apparatus that facilitate exercise involving the movement of weights subject to gravitational force. Generally speaking, the present invention allows a person to adjust weight resistance by latching a desired number of weights relative to a lifting member and/or securing a desired amount of weight on opposite ends of a base member. The present invention may be applied to exercise weight stacks and/or free weight assemblies such as dumbbells and barbells.

A preferred embodiment of the present invention may be described in terms of an exercise dumbbell having a handle; first weights and second weights disposed at respective ends of the handle and maintained in spaced relationship relative thereto; and first and second selectors disposed at respective ends of the handle. Each selector includes a first selector rod segment that is movable into engagement with at least a first weight plate, and a second selector rod segment that is movable into engagement with at least a second weight plate.

On one embodiment, the first selector rod segment is the relatively longer distal end portion of a generally J-shaped selector rod, and the second selector rod segment is the relatively shorter distal end portion. The relatively longer segment is preferably alignable with any one of a plurality of holes associated with the handle, while the relatively shorter segment is alignable with either another one of the holes or a separate, radially inward hole.

On another embodiment, the first selector rod segment is a distal end portion of a generally J-shaped selector rod, and the second selector rod segment includes a peg that is rotatably mounted on an intermediate portion of the selector rod. The first selector rod segment is preferably alignable with a plurality of holes disposed at a common radius from a longitudinal axis defined by the handle. The second selector rod segment is preferably alignable with a radially inward hole.

The latter embodiment may also be described in terms of adjusting weight based on the orientation of a block relative to a selector rod. In this regard, when the block occupies a first orientation relative to the selector rod and the selector rod is moved to a latched position relative to the handle, a first number of weights is selectively connected to the handle, and when the block occupies a second orientation relative to the selector rod and the selector rod is moved to a latched position relative to the handle, a second, relatively greater number of weights is selectively connected to the handle.

Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 3 is an end view of the dumbbell of FIG. 1;

FIG. 4 is an end view of the handle assembly of FIG. 2;

FIG. 9 is an end view of an alternative embodiment exercise dumbbell system constructed according to the principles of the present invention;

FIG. 10 is an end view of a weight plate that is part of the dumbbell system of FIG. 9;

DETAILED DESCRIPTION OF A PREFERRED EMBODIMENT

The present invention is disclosed with reference to exercise dumbbell systems with the understanding that one or more features and/or combination of features may be applied to other types of exercise equipment, including certain weight stack machines, for example. Some examples of "cross-over" applications are disclosed in U.S. Pat. No. 6,033,350 to Krull, which is incorporated herein by reference together with U.S. Pat. No. 6,322,481 to Krull.

Figure 1:
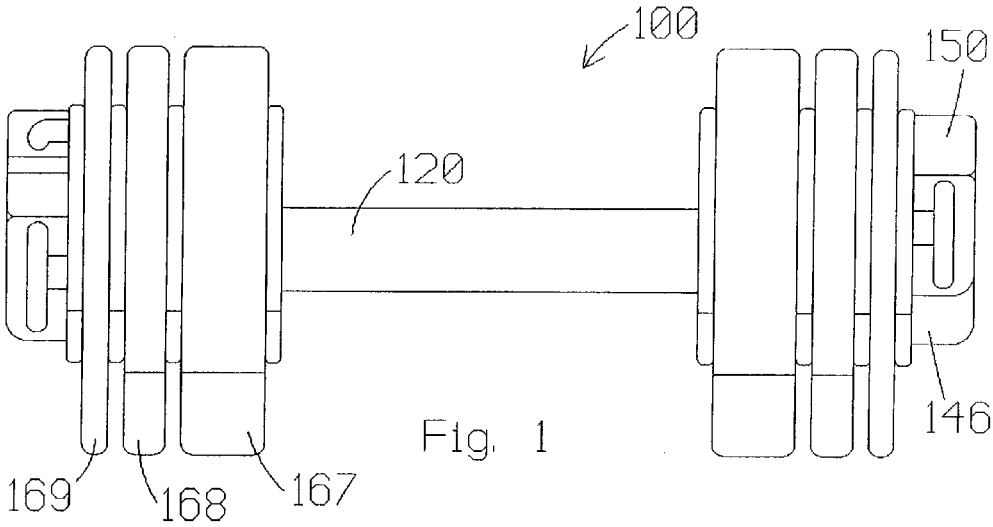
FIG. 1 is a side view of a preferred embodiment exercise dumbbell constructed according to the principles of the present invention.
Figure 8:
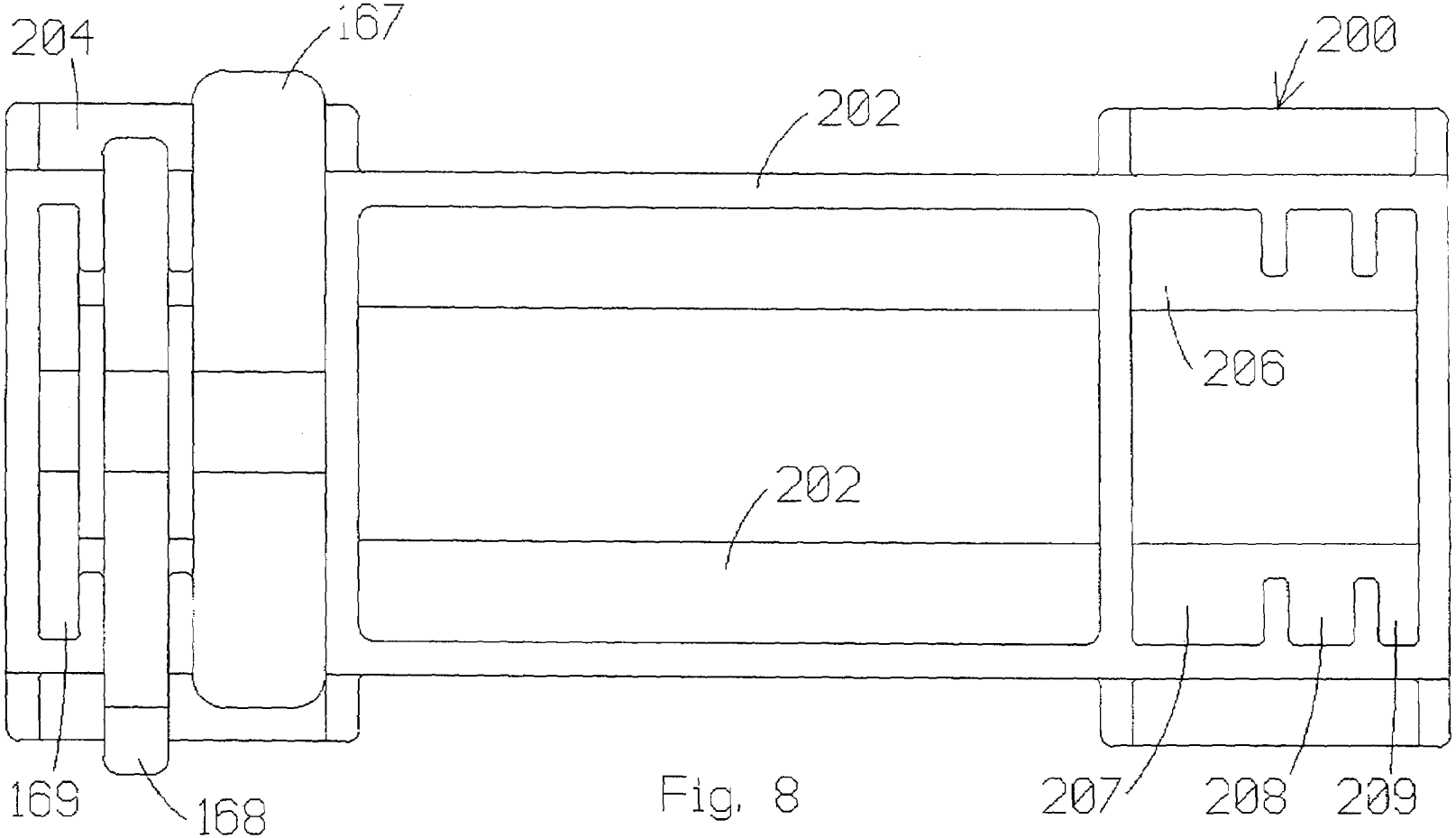
FIG. 8 is a top view of each of the weight plates of FIGS. 5–7 resting on a base.

A first exercise dumbbell constructed according to the principles of the present invention is designated as 100 in FIGS. 1 and 3. Generally speaking the dumbbell 100 includes a lifting member or handle assembly 110, and a plurality of weight plates 167–169 that are selectively connected to the handle assembly 110. A base or cradle 200 (shown in FIG. 8) is preferably provided to support the weight plates 167–169 in a rest position (with or without the handle assembly 110).

The base 200 is preferably made of plastic and formed by injection molding. The base 200 includes opposite end weight compartments that are interconnected by intermediate rails and/or walls 202. Each weight compartment defines three slots 207–209 that are configured to receive respective weight plates 167–169, and each weight compartment is bounded by opposite sidewalls that are configured to accommodate respective shoulders on the weight plates 167–168. At least a partial bottom wall 206 is provided on the base 200 to support the weight plates 167–169. Stabilizing tabs or feet 204 may be provided to discourage tipping of the base 200 relative to an underlying support surface. Those skilled in the art will recognize that the dumbbell 100 may be used in conjunction with other bases, as well (including those disclosed in the patents incorporated herein by reference).

The handle assembly 110 includes a bar 112 that is preferably a square tube made of steel. The bar 112 extends substantially the entire length of the handle assembly 110 and defines a longitudinal axis. A hand grip 120 is mounted on an intermediate portion of the bar 112. The hand grip 120 is preferably a cylindrical tube made of plastic, and it may be knurled and/or contoured to facilitate a comfortable and reliable grip. The hand grip 120 fits snugly onto the bar 112 in a manner that prevents rotation relative thereto.

First and second sets of support plates 136–139 and spacers 117–119 are mounted in alternating fashion on respective ends of the bar 112. The support plates 136–139 and the spacers 117–119 also fit snugly onto the bar 112 in a manner that prevents rotation relative thereto. The support plates 136–139 and the spacers 117–119 cooperate to define slots sized and configured to receive respective weight plates 167–169.

Both the support plates 136–139 and the spacers 117–119 are preferably made of plastic and formed by injection molding. The plates 136–139 and the spacers 117–119 may be configured and arranged to limit the number of required parts, reduce the accumulation of manufacturing tolerances, and/or enhance the structural integrity of the handle assembly 110. For example, each spacer 117–119 and a respective adjacent plate 137–139 may be combined into a unitary part.

The support plates 136–139 may be described with reference to the outer support plate 139 shown in FIGS. 3–4, which is representative of the other support plates 136–138. A square hole (not shown) extends through the center of the plate 139 to accommodate a snug fit on the bar 112 and prevent rotation relative thereto. Four pairs of holes extend through the plate 139, and the plate 139 bears indicia associated with these holes. Each pair of holes includes a first hole disposed at a first common radius from the center of the plate 139 (and from the axis of the bar 112), and a second hole disposed at a second, relatively greater common radius from the center of the plate 139 (and from the axis of the bar 112).

Each of the spacers 117–119 may be described as a substantially hollow block that is configured to occupy a slot in a respective weight plate 167–169. In this regard, the spacers 117–119 have a common profile, and respective thicknesses that are slightly greater than the thicknesses of respective weight plates 167–169. A square hole extends through the lower end of each spacer 117–119 to accommodate a snug fit on the bar 112 and prevent rotation relative thereto. An adjacent opening may be provided in the upper portion of each spacer 117–119 to improve the strength-to-mass ratio of the part (and/or to accommodate insertion of a relative smaller weight for purposes of obtaining smaller incremental changes in the effective weight of the dumbbell).

A respective fastener 102 is secured to each end of the bar 112, preferably in a manner that clamps the other components of the handle assembly 110 therebetween. For example, each fastener 102 may be a nut that is configured to thread onto a respective end of the bar 112 and span a portion of the opening extending through the bar 112. A hole extends through a center portion of the fastener 102 to accommodate passage of a respective selector rod 140, as further explained below. An alternative fastener may be provided in the from of a generally C-shaped clip that extends through grooves in diametrically opposed corners of the bar 112. This alternative fastener may be secured in place by snap fit and/or a screw that extends axially through the fastener and the adjacent end plate.

Figure 2:
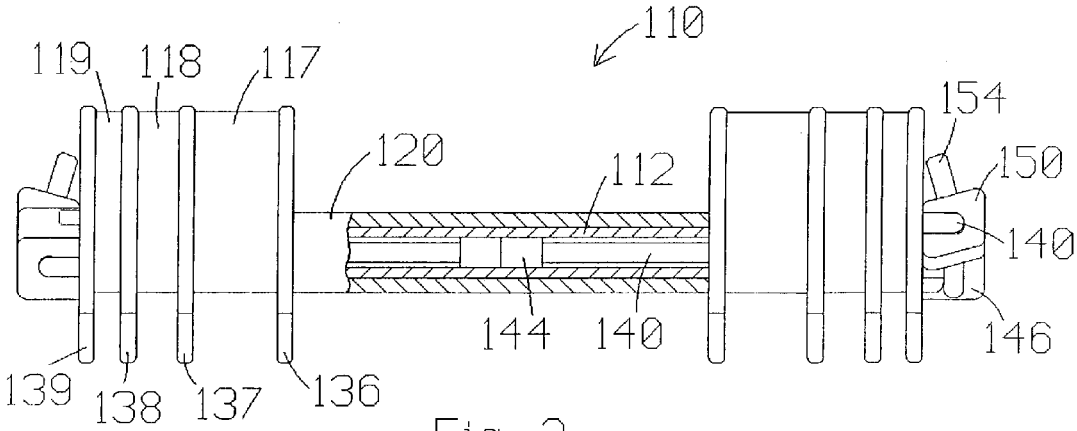
FIG. 2 is a partially sectioned side view of a handle assembly that is part of the dumbbell of FIG. 1.

Each selector rod 140 may be described as a generally J-shaped rod that is preferably made of steel. Each selector rod 140 has a relatively longer end portion that extends axially through a respective fastener 102, an intermediate portion that extends radially, and a relatively shorter end portion that extends axially. As shown in FIG. 2, cylindrical plugs 144 are slidably installed inside the handle bar 112, and secured to the distal ends of respective longer end portions. Each plug 144 cooperates with the bar 112 and a respective fastener 102 to movably connect a respective selector rod 140 to the handle bar 112 for movement along the axis and rotation about the axis. Attracting magnets may be secured to respective plugs 144 to resist separation therebetween.

At each end of the handle assembly 110, a selector block 150 is rotatably mounted on the intermediate portion of a respective selector rod 140, and the block 150 and the selector rod 140 cooperate to define a weight selector assembly. A selector rod segment or peg 154 projects outward from the block 150 for reasons discussed below. A hand grip 146 is preferably mounted on the intermediate portion of the selector rod 140 to facilitate maneuvering of the selector rod 140 relative to the bar 112. The hand grip 146 also maintains the block 150 in a desired position radial position along the intermediate portion of the bar 112, with the peg 154 disposed at the same radius from the center of the plate 139 as the first, radially inward holes in the plate 139. The length of the intermediate portion of the bar 112 is such that the shorter end portion of the selector rod 140 is disposed at the same radius from the center of the plate 139 as the second, radially outward holes in the plate 139. Also, the shorter end portion is preferably just long enough to span the thicknesses of the support plates 136–139 and the spacers 117–119.

Figure 5:
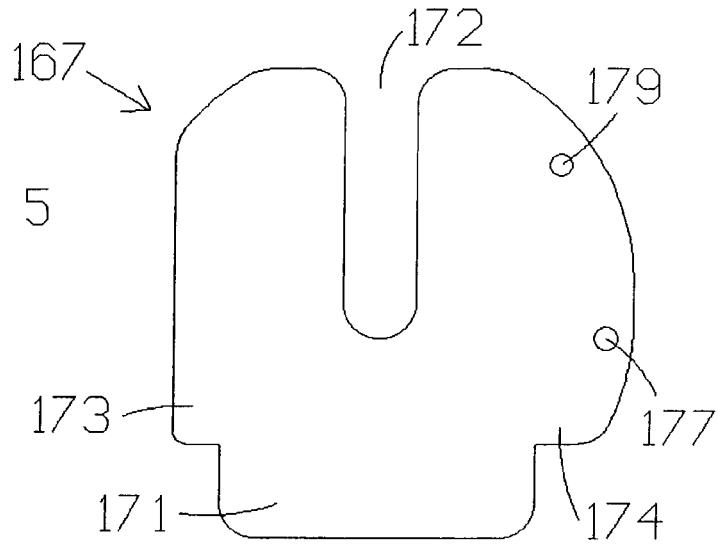
FIG. 5 is an end view of a first weight plate on the dumbbell of FIG. 1.

One of the weight plates 167 is shown by itself in FIG. 5. The plate 167 is preferably made of steel and configured to weigh five pounds (or 2.5 kg on a comparable metric embodiment). An upwardly opening slot 172 extends through the plate 167 and is configured to receive a spacer 117. The plate 167 has a lower end 171 that is configured for insertion into a respective slot 207 in the base 200. The upper portion of the plate 167 is bounded by opposite side shoulders 173 and 174 that define a relatively greater width than the lower end 171. The shoulder 174 is relatively broader or more outwardly protruding, and is provided with holes 177 and 179 that align with respective radially outward holes in the support plate 139 when a respective spacer 117 occupies the slot 172.

Figure 6:
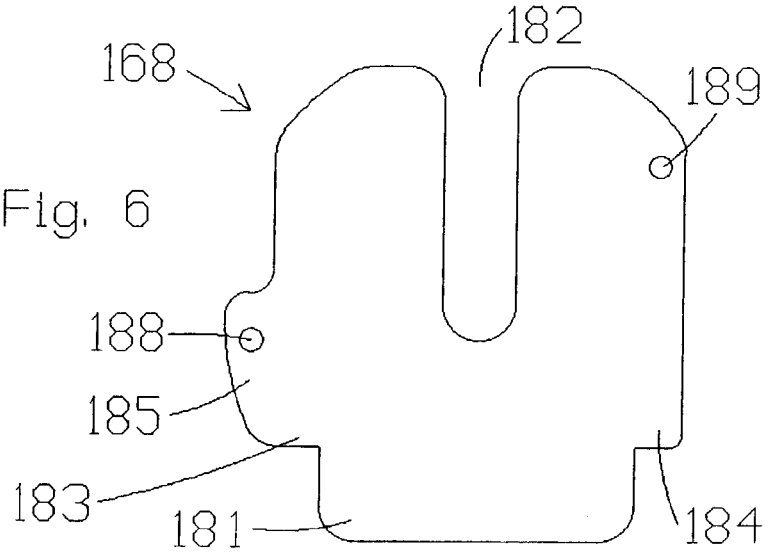
FIG. 6 is an end view of a second weight plate on the dumbbell of FIG. 1.

One of the weight plates 168 is shown by itself in FIG. 6. The plate 168 is preferably made of steel and configured to weigh two and one-half pounds (or 1.25 kg on a comparable metric embodiment). An upwardly opening slot 182 extends through the plate 168 to receive a spacer 118. The plate 168 has a lower end 181 that is configured for insertion into a respective slot 208 in the base 200. The upper portion of the plate 168 is bounded by opposite side shoulders 183 and 184 that define a relatively greater width than the lower end 181. A tab 185 extends outward from the shoulder 183 and is provided with a hole 188, and another hole 189 extends through the opposite shoulder 184. The holes 188 and 189 align with respective radially outward holes in the support plate 139 when a respective spacer 118 occupies the slot 182.

Figure 7:
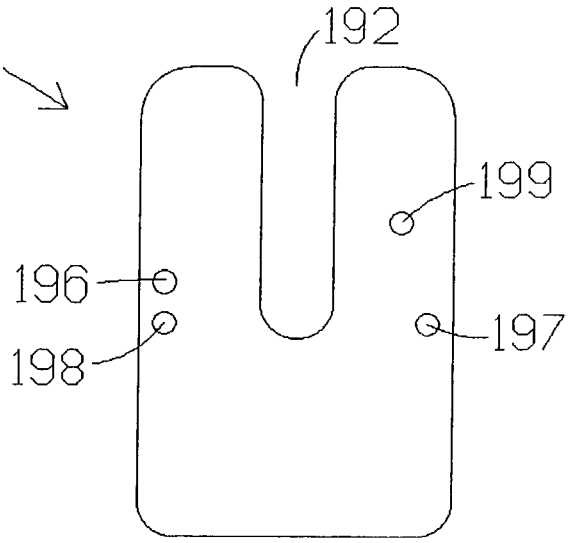
FIG. 7 is an end view of a third weight plate on the dumbbell of FIG. 1.

One of the weight plates 169 is shown by itself in FIG. 7. The plate 169 is preferably made of steel and configured to weigh one and one-quarter pounds (or 0.625 kg on a comparable metric embodiment). An upwardly opening slot 192 extends through the plate 169 and is configured to receive a respective spacer 119. The plate 169 has a uniform width that is similar to the width of the lower ends 181 and 171 on the weight plates 180 and 170, respectively. In other words, the plates 169 are similarly configured for insertion into respective slots 209 in the base 200, but they do not have outwardly projecting shoulders. Holes 196–199 extend through the plate 169, and are arranged to align with respective radially inward holes in the support plate 139 when a respective spacer 119 occupies the slot 192.

Among other things, FIG. 3 shows an end view of the weight plates 167–169 in axial alignment with the end plate 139. The shorter end portion of the selector rod 140 has been rotated into alignment with and inserted through the radially outward "17.5/20" holes in respective support plates 137–139, and through the holes 189 and 179 in respective weight plates 168 and 167, and preferably into the aligned hole in the support plate 136. In other words, FIG. 3 shows the weight plates 168 and 167 selectively connected to the handle assembly 110 by means of the selector rod 140. Also, the selector peg 154 has been maneuvered to extend through the radially inward "17.5/20" hole in the support plate 139, and through the hole 199 in the weight plate 169, and preferably into the aligned hole in the adjacent support plate 138. In other words, FIG. 3 shows the weight plate 169 selectively connected to the handle assembly 110 by means of the selector block 150.

When each weight selector assembly is arranged as shown in FIG. 3, all of the weight plates 167–169 are selectively connected to the handle assembly 110, and the indicia on the end plate 139 correctly indicates that the fully loaded dumbbell 100 will weigh twenty pounds (or 10.0 kg on a comparable metric embodiment) when lifted from the base 200. As suggested by the indicia on the end plate 139, the weight of the dumbbell 100 may be reduced to seventeen and one-half pounds (or 8.75 kg on a comparable metric embodiment) by withdrawing the pegs 154 from engagement with respective weight plates 169.

FIG. 4 shows the handle assembly 110 without any weight plates 167–169 connected thereto. In this configuration, the shorter end portion of the selector rod 140 has been rotated into alignment with and inserted through the radially outward "2.5/5" holes in respective support plates 137–139, past the outside edges of respective weight plates 168 and 167, and preferably into the aligned hole in the support plate 136. Also, the selector peg 154 has been maneuvered to extend alongside (and somewhat toward) the support plate 139, rather than through it. When each weight selector assembly is arranged as shown in FIG. 4, none of the weight plates 167–169 is selectively connected to the handle assembly 110, and the indicia on the end plate 139 correctly indicates that the empty handle assembly will weigh two and one-half pounds (or 1.25 kg on a comparable metric embodiment) when lifted from the base 200. As suggested by the indicia on the end plate 139, the weight of the dumbbell 100 may be increased to five pounds (or 2.5 kg on a comparable metric embodiment) by maneuvering the pegs 154 into engagement with respective weight plates 169.

The following chart shows the amounts of balanced weight that may be selected by maneuvering the selector rod 140 and the selector peg 150 into different arrangements.

| Hole:Peg | Handle | Weights 167 | Weights 168 | Weights 169 | Total |
|---|---|---|---|---|---|
| 2.5/5:N | 2.5 | 0 | 0 | 0 | 2.5 |
| 2.5/5:Y | 2.5 | 0 | 0 | 2.5 | 5.0 |
| 7.5/10:N | 2.5 | 0 | 5.0 | 0 | 7.5 |
| 7.5/10:Y | 2.5 | 0 | 5.0 | 2.5 | 10.0 |
| 12.5/15:N | 2.5 | 10.0 | 0 | 0 | 12.5 |
| 12.5/15:Y | 2.5 | 10.0 | 0 | 2.5 | 15.0 |
| 17.5/20:N | 2.5 | 10.0 | 5.0 | 0 | 17.5 |
| 17.5/20:Y | 2.5 | 10.0 | 5.0 | 2.5 | 20.0 |

An advantage of the dumbbell 100 is that only three discrete weight plates are required on each side of the dumbbell to provide eight different, balanced dumbbell loads. Another advantage of the dumbbell 100 is that seven additional, somewhat out of balance loads may be selected, as well. For example, the handle assembly 110 may be set to weigh six and one-quarter pounds by selecting only the weight plate 169 at one end of the handle assembly 110, and only the weight plate 168 at the other end of the handle assembly 110.

Various modifications may be made to the dumbbell 100 to arrive at alternative embodiments of the subject invention. For example, different latching and/or biasing arrangements may be used in connection with the selector rod 140 and/or the selector block 150, and some such possibilities are disclosed in the patents that are incorporated herein by reference. For example, compression springs may be disposed between respective plugs 144 and respective end plates 139 to bias the selector rods 140 toward respective weight engaging positions, and/or to resist movement of the selector rods 140 away from respective weight engaging positions. Also, the weight plates may be arranged in a different order, and/or provided in different numbers, weight amounts, and/or combinations. For example, a handle assembly weighing ten pounds may be combined with weight plates weighing ten pounds, five pounds, and two and one-half pounds to provide a dumbbell that is adjustable between ten and forty-five pounds in balanced five pound increments.

On the depicted embodiment, the weight plates 167–169 at one end of the dumbbell 100 (and/or the base 200) are rotated one hundred and eighty degrees (about a vertical axis) relative to the weight plates 167–169 at the opposite end of the dumbbell 100 (and/or the base 200). This arrangement generally maintains balance despite the eccentric shapes of the weight plates 167–168. On an alternative embodiment, the weight plates may be arranged as mirror images of one another, in which case the selector rods 140 would assume like orientations in order to select like amounts of weight at each end of the dumbbell.

FIG. 9 shows another dumbbell system constructed according to the principles of the present invention. This system similarly includes a dumbbell 300 having a handle assembly and weight plates selectively connected thereto, as well as a base 200' that supports the weight plates in a rest position. The base 200' is like the base 200 but with a different slot configuration at each end to accommodate a different set of weight plates. In this regard, at each end of the dumbbell 300, there are two one pound plates (one of which is shown by itself in FIG. 10), a three pound plate (having a planform and hole arrangement similar to the plate 168 shown in FIG. 6), and a six pound plate (having a planform and hole arrangement similar to the plate 167 shown in FIG. 5).

As shown in FIG. 9, the dumbbell 300 has different support plates (one of which is designated as 339 in FIG. 9), and a second selector block 350 has been substituted for the handle 146 on the first embodiment 100. The block 350 is similarly rotatably mounted on the intermediate portion of the selector rod 140, and a relatively longer peg or selector rod segment 354 projects outward therefrom. In addition to having holes like those on the first embodiment 100, the support plate 339 has additional holes at a third, innermost common radius from the center of the support plate 339 (and from the longitudinal axis of the handle). The peg 354 is configured and arranged for insertion through any one of these innermost holes and through respective aligned holes 396–399 in both adjacent weight plates 369. As on the first dumbbell 100, the peg on the selector block 150 is configured and arranged for insertion through any of the intermediate radius holes in the support plate 339 and through respective aligned holes 196–199 in an adjacent weight plate 369.

The two selector blocks 150 and 350 on the selector rod 140 facilitate a greater range of available weight and/or relatively smaller increments of weight adjustment. In this case, for example, the dumbbell 300 is adjustable between three pounds and twenty-five pounds in balanced increments of two pounds. FIG. 9 shows the dumbbell 300 set to weigh three pounds (those skilled in the art will recognize that the handle assembly may be modified in various ways to weigh one-half pound more than its counterpart 110 on the dumbbell 100). The dumbbell 300 may be adjusted to weigh five pounds by maneuvering each peg 154 into engagement with a respective, outermost weight plate 369, and/or the dumbbell 300 may be adjusted to weight seven pounds by maneuvering each peg 354 into engagement with both respective weight plates 369.

Figure 11:
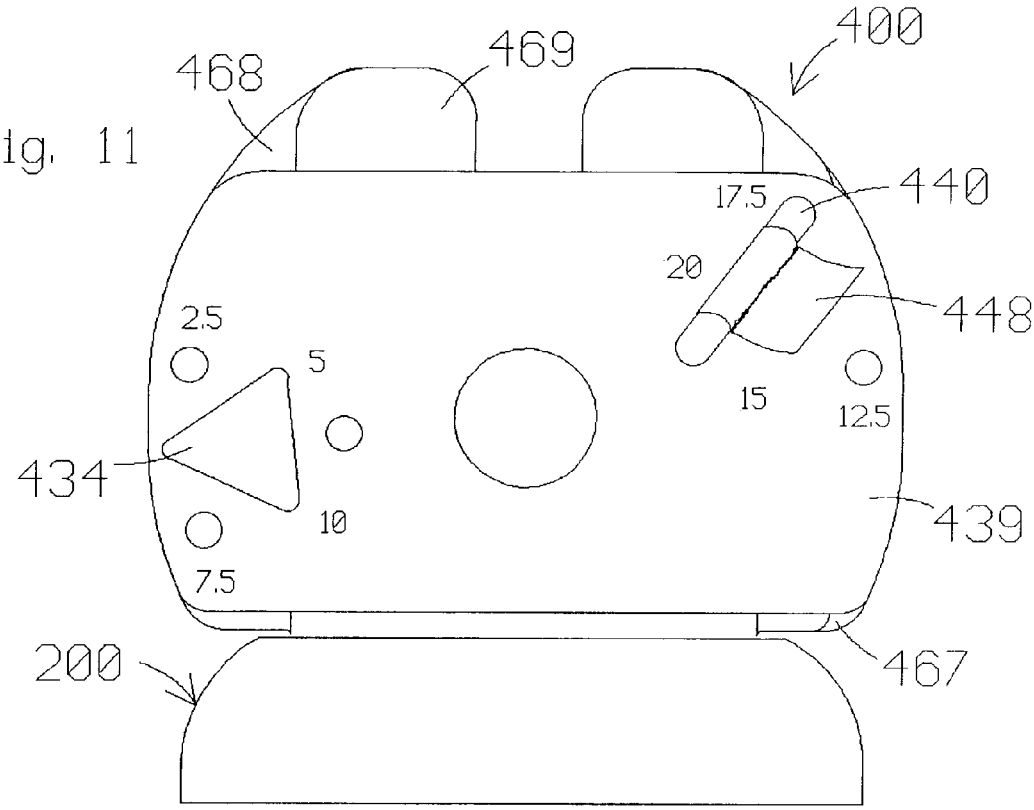
FIG. 11 is end view of another alternative embodiment exercise dumbbell system constructed according to the principles of the present invention.

FIG. 11 shows yet another dumbbell system constructed according to the principles of the present invention. This system similarly includes a dumbbell 400 having a handle assembly and weight plates selectively connected thereto, as well as an identical base 200 that supports the weight plates in a rest position. In this regard, the dumbbell 400 includes weight plates 467–469 that are identical in size and shape to respective weight plates 167–169, but with different hole arrangements (to align with respective holes in end plate 439).

Three holes extend through the left side of the end plate 439, and three holes extend through the right side of the end plate 439. On each side of the end plate 439, the three holes are arranged in a manner that defines an equilateral triangle, and two of the three holes are disposed at a common radius from the center of the end plate 439 (and from the longitudinal axis of the handle), and the other hole is disposed radially inward. The two radially inward holes align with holes in the outermost weight plate 469 (which is configured to weigh one and one-quarter pounds). The radially outward holes associated with the indicia "7.5" and "17.5" align with holes in the middle weight plate 468 (which is configured to weigh two and one-half pounds). The radially outward holes associated with the indicia "12.51" and "17.5" align with holes in the innermost weight plate 467 (which is configured to weigh five pounds). On an alternative embodiment, a separate radially inward hole may be paired with each radially outward hole, preferably in such a manner that each four hole set defines a rhombus.

Figure 12:
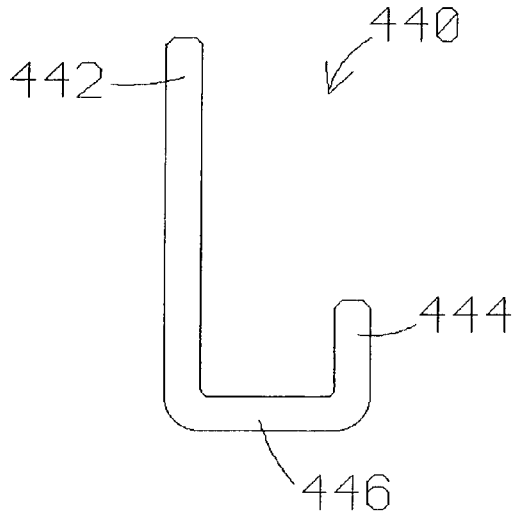
FIG. 12 is a side view of a selector rod that is part of the dumbbell system of FIG. 11.

FIG. 12 shows a selector 440 that is configured for insertion into any two holes within either set of three holes. The selector 440 may be described as a J-shaped rod that is preferably made of steel. The selector 440 includes a first selector rod segment 442, a second, relatively shorter selector rod segment 444, and a third, intermediate segment 446. The first segment 442 is configured for insertion through any of the radially outward holes in the outer three support plates, and through aligned holes in respective weight plates 468 and 467, and into an aligned hole in the innermost support plate. The second segment 444 is configured for insertion through either of the radially inward holes in the support plate 439, and through an aligned hole in the outermost weight plate 469, and into an aligned hole in the next adjacent support plate. The second segment 444 may alternatively be inserted into any of the radially outward holes when engagement of the outermost weight plate 469 is not desired.

When each end of the dumbbell 400 is configured as shown in FIG. 11, all of the weight plates 467–469 are engaged, and the dumbbell 400 will weigh twenty pounds when lifted from the base 200. The weight of the dumbbell 400 may be reduced to seventeen and one-half pounds by withdrawing each second segment 444 from a respective radially inward hole, and inserting each second segment into a respective "12.5" hole instead. The weight of the dumbbell 400 may be reduced to two and one-half pounds by inserting each first segment 442 into a respective "2.5" hole, and inserting each second segment 444 into a respective "7.5" hole.

FIG. 11 shows that a flexible tail 448 may be secured to the intermediate portion 446 of the selector 440 to facilitate its withdrawal from the handle assembly. The tail 448 is preferably a strip of cloth that is sewn into a closed loop about the intermediate portion 446 of the selector 440. FIG. 11 also shows that a latching material 434 may be provided on the end plate 439 to latching the selector 440 in a weight engaging position relative to the handle assembly. The latching material 434 is preferably a magnet or a hook-and-loop type material. Many other latching arrangements may be used in addition and/or in the alternative, as suggested by at least one of the patents incorporated herein by reference. Those skilled in the art will also recognize that the selectors 440 may be operated relative to the innermost support plates, rather than the outermost support plates 439, and/or that the relative positions of the weight plates 467–469 may be switched, if desired. Furthermore, many of the variations and features discussed above with respect to any particular embodiment may be applicable to other embodiments, as well.

The subject invention may also be described in alternative terms, including, for example, adjustable weight exercise systems. One such system includes a weight lifting member that defines a longitudinal axis; weight supports mounted on the weight lifting member; weights sized and configured to be supported by the weight supports; and at least one weight selector assembly that is operable to select a first combination of the weights when a selector block occupies a first orientation relative to a selector rod, and to select a different, second combination of the weights when the selector block occupies a different, second orientation relative to the selector rod.

In accordance with the foregoing system, another dumbbell embodiment of the present invention includes blocks that are eccentrically mounted on selector rods. When one such block occupies a first orientation, a respective selector rod is available for insertion into a first subset of weight plates, and when the block is rotated to a second orientation, the selector rod is available for insertion into a second subset of weight plates. In other words, the effective length of the selector rod is a function of the block's orientation relative thereto.

Another such system may be described in terms of a lifting member having spaced apart weight supports; weights sized and configured to be supported by the weight supports; a base sized and configured to support the weights; and a weight selecting means for selectively connecting different combinations of the weights to the lifting member, wherein the weight selecting means includes a first selector rod segment and a second selector rod segment that are maneuverable into different arrangements relative to the lifting member, including a first arrangement wherein the first selector rod segment engages a first one of the weights, and the second selector rod segment engages a second one of the weights, and a second arrangement, wherein the first selector rod segment engages the first one of the weights, and the second selector rod segment is disengaged from the second one of the weights, and a third position, wherein the first selector rod segment is disengaged from the first one of the weights, and the second selector rod segment engages the second one of the weights, and in each said arrangement, a common distance is defined between the first selector rod segment and the second selector rod segment.

The present invention may also be described in terms of various methods of adjusting resistance to exercise (with reference to the embodiments disclosed herein, for example). One such method involves providing a weight lifting member having weight supports and defining a longitudinal axis; providing weights sized and configured to be supported by the weight supports; providing a weight selector assembly having a selector rod and a selector block; rotating the block to a first orientation relative to the rod and maneuvering the assembly into engagement with a first combination of the weights; and alternatively rotating the block to a second orientation relative to the rod and maneuvering the assembly into engagement with a second combination of the weights.

The foregoing description references specific embodiments and particular applications that will lead persons skilled in the art to derive additional embodiments, applications, and/or improvements. Therefore, the scope of the present invention is to be limited only to the extent of the following claims.

What is claimed is:

1. A method of adjusting weight resistance to exercise, comprising the steps of:

providing a weight lifting member having weight supports and defining a longitudinal axis;

providing weights sized and configured to be supported by the weight supports;

providing a weight selector assembly having a rod that is sized and configured for insertion into at least some of the weights, and a block that is rotatably mounted on the rod;

selectively rotating the block between a first orientation relative to the rod and a second orientation relative to the rod; and moving the selector assembly into a latched position relative to the lifting member to connect a first selection of the weights to the lifting member when the block occupies the first orientation relative to the rod, and to alternatively connect a discrete, second selection of the weights to the lifting member when the block occupies the second orientation relative to the rod.

2. The method of claim 1, further comprising the step of providing a base to support the weights in a rest position.

3. The method of claim 1, wherein the weight lifting member is provided with a handle, and a first group of the weight supports is disposed at one end of the handle, and a second group of the weight supports is disposed at an opposite end of the handle.

4. The method of claim 3, further comprising the step of providing a base to support a first group of the weights at a fixed distance apart from a second group of the weights.

5. The method of claim 3, further comprising the step of selectively rotating the rod relative to the lifting member before moving the selector assembly to a latched position relative to the lifting member, wherein when the rod occupies a first orientation relative to the lifting member, the first selection of weights is selectively connected to the lifting member when the selector assembly is moved to a latched position relative to the lifting member, and when the rod occupies a second orientation relative to the lifting member, a third selection of the weights is selectively connected to the lifting member when the selector assembly is moved to a latched position relative to the lifting member.

6. The method of claim 1, wherein the block is provided with a selector peg, and when the block occupies the second orientation relative to the rod, the moving step involves aligning the peg with a hole in one of the weights and inserting the peg into the hole to underlie said one of the weights.

7. An exercise dumbbell, comprising:

a handle assembly having a handle that defines a longitudinal axis, and weight supports secured to opposite ends of the handle;

first weights and second weights sized and configured to be supported by the weight supports at respective ends of the handle; and a first weight selector assembly and a second weight selector assembly, wherein each said weight selector assembly includes a rod that is movably mounted on the handle assembly, and a block that is movably mounted on the rod, and each said weight selector assembly is selectively maneuverable into engagement with different combinations of respective said weights, including a first combination wherein the block occupies a first position relative to the rod, and a discrete, second combination wherein the block occupies a discrete, second position relative to the rod.

8. The exercise dumbbell of claim 7, further comprising a base configured to support the weights in a rest position at a fixed distance apart from one another.

9. The exercise dumbbell of claim 7, wherein each said rod is generally J-shaped, and includes a first, relatively longer end portion that is slidably and rotatably connected to the handle assembly, and a second, relatively shorter end portion that is configured for insertion into at least some respective said weights.

10. The exercise dumbbell of claim 9, wherein the block is rotatably mounted on an intermediate portion of the rod that extends perpendicular to each said end portion.

11. The exercise dumbbell of claim 10, wherein a peg projects outward from the block and is configured for insertion into at least one of said weights.

12. The exercise dumbbell of claim 7, wherein said first weights include a first weight plate, a second weight plate, and a third weight plate, and the rod is configured and arranged to selectively underlie different combinations of the first weight plate and the second weight plate, and the block is configured and arranged to underlie the third weight plate when the block occupies the second position.

13. The exercise dumbbell of claim 12, wherein the rod is configured and arranged to span the third weight plate without underlying the third weight plate.

14. The exercise dumbbell of claim 12, wherein a peg projects outward from the block and is configured for insertion beneath at least a portion of the third weight plate.

15. The exercise dumbbell of claim 7, further comprising a latching means for latching each said weight selector assembly in a weight engaging position relative to the handle assembly.

16. An adjustable weight exercise system, comprising:

a handle assembly having a handle that defines a longitudinal axis, and weight supports secured to opposite ends of the handle;

first weights and second weights sized and configured to be supported by the weight supports at respective ends of the handle;

a base sized and configured to support the first weights and the second weights at a fixed distance apart from one another;

a first selector rod and a second selector rod, wherein each said selector rod is movably mounted on the handle assembly for selective engagement of different combinations of respective said weights; and a first selector block and a second selector block, wherein each said selector block is movably mounted on a respective selector rod for engagement of additional combinations of respective said weights when the selector block is selectively repositioned relative to the rod.

17. The adjustable weight exercise system of claim 16, wherein each said selector rod is configured and arranged for movement axially relative to the handle assembly, and for rotation about the axis relative to the handle assembly.

18. The adjustable weight exercise system of claim 16, wherein at least one peg projects outward from each said selector block.

19. The adjustable weight exercise system of claim 18, wherein each said peg is configured and arranged for insertion into at least one of the weights at a first radial distance from the axis.

20. The adjustable weight exercise system of claim 19, wherein each said selector rod is configured and arranged for insertion into at least one of the weights at a second, relatively greater radial distance from the axis.

21. An exercise dumbbell, comprising:

a handle that defines a longitudinal axis;

weight supports mounted on opposite ends of the handle;

weights sized and configured to be supported in respective, axially spaced positions defined by the weight supports; and a weight selector on the handle assembly, wherein the weight selector includes a first selector rod segment configured to engage a first subset of the weights upon insertion into a first passage defined by at least one of the weight supports, and a second selector rod segment configured to simultaneously engage a second subset of the weights upon insertion into a second passage defined by at least one of the weight supports, wherein the second selector rod segment is linked to the first selector rod segment, and the first passage is disposed at a first distance from the axis, and the second passage is disposed at a second, relatively smaller distance from the axis.

22. The exercise dumbbell of claim 21, wherein at least one additional passage is disposed at the first distance from the axis to alternatively receive the first selector rod segment, and at least one additional passage is disposed at the second distance from the axis to alternatively receive the second selector rod segment.

23. The exercise dumbbell of claim 21, wherein the weight selector further includes a third selector rod segment configured to engage a third subset of the weights upon insertion into a third passage defined by at least one of the weight supports.

24. The exercise dumbbell of claim 21, further comprising a base configured to support the weights in a rest position.

25. An adjustable weight exercise system, comprising:

a lifting member having spaced apart weight supports;

weights sized and configured to be supported by the weight supports;

a base sized and configured to support the weights; and a weight selecting means for selectively connecting different combinations of the weights to the lifting member, wherein the weight selecting means includes a first selector rod segment and a second selector rod segment that are maneuverable into different arrangements relative to the lifting member, including a first arrangement wherein the first selector rod segment engages a first one of the weights, and the second selector rod segment engages a second one of the weights, and a second arrangement, wherein the first selector rod segment engages the first one of the weights, and the second selector rod segment is disengaged from the second one of the weights, and a third position, wherein the first selector rod segment is disengaged from the first one of the weights, and the second selector rod segment engages the second one of the weights, and in each said arrangement, a common distance is defined between the first selector rod segment and the second selector rod segment.

* * * * *